US005548519A

United States Patent [19]

Park et al.

[11] Patent Number: 5,548,519

[45] Date of Patent: Aug. 20, 1996

[54] CUSTOM APPAREL MANUFACTURING APPARATUS AND METHOD

[75] Inventors: Sung K. Park, Jamaica Plain; Bethe M. Palmer, Marblehead; Gerald S. Ruderman, Wellesley, all of Mass.

[73] Assignee: Custom Clothing Technology Corporation, Newton, Mass.

[21] Appl. No.: 289,406

[22] Filed: Aug. 12, 1994

[51] Int. Cl.[6] ..... G06F 19/00

[52] U.S. Cl. ..... 364/470.06; 364/188

[58] Field of Search ..... 364/470, 188, 364/468, 189, 469; 395/50, 54, 68

[56] References Cited

U.S. PATENT DOCUMENTS

| | | | |
|---|---|---|---|
| 358,903 | 3/1987 | Weir . | |
| 633,654 | 9/1899 | Milich . | |
| 1,121,410 | 12/1914 | Scribante . | |
| 1,732,367 | 10/1929 | Leeman . | |
| 2,231,437 | 2/1941 | Cieri . | |
| 2,374,654 | 5/1945 | Coate . | |
| 2,615,250 | 10/1950 | Fessler . | |
| 2,631,374 | 3/1953 | Purdy . | |
| 2,762,124 | 9/1956 | DiAngelo . | |
| 3,091,861 | 6/1963 | Jones . | |
| 3,266,528 | 10/1973 | Ichida . | |
| 3,391,392 | 7/1968 | Doyle . | |
| 3,529,298 | 10/1970 | Lourie . | |
| 3,566,365 | 2/1971 | Rowson . | |
| 3,765,349 | 10/1973 | Gerber . | |
| 3,887,903 | 6/1975 | Martell . | |
| 3,895,358 | 7/1975 | Pearl . | |
| 3,902,182 | 8/1975 | Hillberg . | |
| 4,136,452 | 1/1979 | McMillan | 33/17 R |
| 4,137,634 | 2/1979 | Klamar | 33/12 |
| 4,149,246 | 4/1979 | Goldman | 364/470 |
| 4,211,011 | 7/1980 | Jacobson . | |
| 4,546,434 | 10/1985 | Gioello | 364/470 |
| 4,586,150 | 4/1986 | Budziak . | |
| 4,598,376 | 7/1986 | Burton et al. | 364/470 |
| 4,635,367 | 1/1987 | Vigede . | |
| 4,677,564 | 6/1987 | Paly et al. | 364/468 |
| 4,868,990 | 9/1989 | Steinberg . | |
| 4,873,643 | 10/1989 | Powell et al. | 364/468 |
| 4,885,844 | 12/1989 | Chun | 33/15 |
| 4,916,624 | 4/1990 | Collins . | |
| 4,916,634 | 4/1990 | Collins et al. | 364/470 |
| 4,926,344 | 5/1990 | Collins et al. | 364/513 |
| 5,163,006 | 10/1992 | Deziel | 364/470 |
| 5,163,007 | 10/1992 | Slilaty | 364/470 |
| 5,341,305 | 8/1994 | Clarino et al. | 364/470 |

FOREIGN PATENT DOCUMENTS

0537388A1 4/1993 European Pat. Off. .

*Primary Examiner*—Paul P. Gordon
*Attorney, Agent, or Firm*—Medlen & Carroll

[57] ABSTRACT

The present invention is a system and method for custom tailoring and manufacturing apparel by using numerous try-on apparels of differing, pre-determined dimensions to make a finished product. A system is used to keep track of the number of try-on apparels and each of their dimensions. As a consumer tries on one of these try-on apparels, a device associated with the system is used to collect the consumer's responses about fit. If one try-on apparel does not fit, the system suggests a next one to try, according to pre-defined rules. When a particular try-on apparel's fit has been approved for purchase by the consumer, this is reported to a manufacturing system, where a piece of apparel corresponding to the dimensions of the approved try-on apparel is cut, stitched, treated, and shipped as a finished apparel.

94 Claims, 15 Drawing Sheets

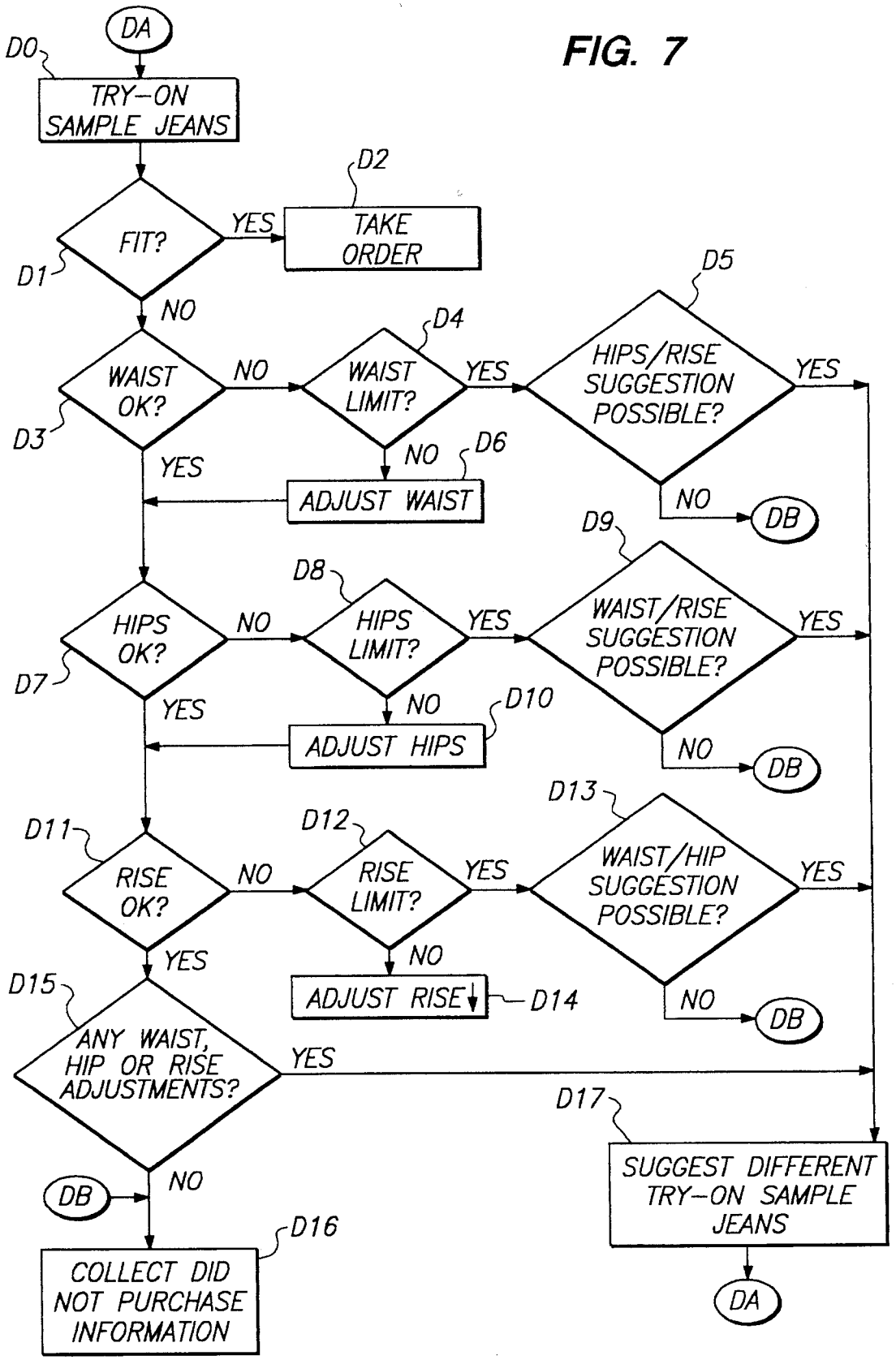
FIG. 7
DA
D0
TRY-ON SAMPLE JEANS
D1
FIT?
YES
D2
TAKE ORDER
NO
D3
WAIST OK?
NO
D4
WAIST LIMIT?
YES
D5
HIPS/RISE SUGGESTION POSSIBLE?
YES
NO
D6
ADJUST WAIST
YES
NO
DB
D7
HIPS OK?
NO
D8
HIPS LIMIT?
YES
D9
WAIST/RISE SUGGESTION POSSIBLE?
YES
NO
D10
ADJUST HIPS
YES
NO
DB
D11
RISE OK?
NO
D12
RISE LIMIT?
YES
D13
WAIST/HIP SUGGESTION POSSIBLE?
YES
NO
ADJUST RISE
D14
NO
DB
D15
ANY WAIST, HIP OR RISE ADJUSTMENTS?
YES
NO
DB
D16
COLLECT DID NOT PURCHASE INFORMATION
D17
SUGGEST DIFFERENT TRY-ON SAMPLE JEANS
DA

CUSTOM APPAREL MANUFACTURING APPARATUS AND METHOD

BACKGROUND

1. Technical Field

This invention relates generally to the custom manufacturing of fitted apparel and more particularly to an apparatus and method for manufacturing custom tailored apparel using multiple try-on apparels and a system.

2. Background of the Invention

For years, a basic problem in making fitted apparel in a cost effective manufacturing system has been determining how to capture a person's body dimensions so that a piece of clothing can be constructed to fit that person well and without undue expense for the manufacturer, retailer or consumer. Apparel designed for three-dimensional objects such as a human body, can be complex to make, since changes in one dimension, such as rise or waist, in the case of pants, may require changes in hip dimensions in order to insure a fit.

Many consumers, particularly women, have trouble finding volume manufactured or ready-made apparel such as blue jeans, that fit to their satisfaction. One cause of this is that the traditional sizing system for women used by volume manufacturers is essentially a single dimensional one developed in 1941. Based on statistical averages, this sizing system results in sizes represented as one abstract dimension, such as size 6 or size 8. Minor variations of this have been added, over time to permit petite or plus sizes, still with one abstract dimension within the petite or plus size subclass, such as size 6 petite or size 6 long or short. Sizes in men's apparel such as pants, shirts and suits are not much different, although shirt sizes may be stocked by neck or arm length dimensions and a few combinations of standard sizes. Generally speaking, the same is true for most other types or configurations of apparel such as footwear, gloves, coats, dresses and so on. While it is theoretically possible to stock a large number of varying standard sizes, to offer more options to a consumer, the costs of maintaining large inventories make that prohibitive. Consequently, only a few standard sizes are offered in most retail stores for consumers.

Nevertheless, in just the simple case of women's pants, there are literally thousands of combinations of waist, hips, rise and inseam measurements that are possible for a pair of blue jeans if a large population is to be fitted. Only one particular combination is likely to be a good fit for any given person. If any one of a person's dimensions are different from the statistical averages, fitting will be harder. If waist size is narrower than the average or the customer desires pants having a shorter rise, it will be difficult to get a good fit from ready-to wear clothing.

In a sample of 500 women measured in a survey, only 11 of the 500, or about 2%, had exact matches to the industry standard sizes.

Hence, many consumers reject ready-to wear and turn to custom fitted clothing. In order to make something custom fit, one must capture key body dimensions, then construct the garment. Four traditional ways have been used in the past to accomplish this:

1. Use a tape measure to measure the person for key dimensions, and then use those dimensions to build the garment.

2. Place the actual garment that the consumer will wear on the person and make tailoring adjustments to that garment.

3. Use an adjustable garment to capture body dimensions.

4. Use some sort of mechanical, optical or video device to capture body dimensions.

The first two approaches used together constitute classical custom tailoring. While generally producing a good fit, the skilled labor of the tailor or seamstress required for traditional custom tailoring makes it too costly for manufacturers and retailers of ready to wear clothing to use, and too expensive for many consumers.

Adjustable try-on garments or patterns are known in the art and have been used to address the problem. This may also require skilled labor at the retail site, in order for the adjustments to be made properly. Whether only one adjustable garment is used or even several adjustable garments in the standard sizes, a considerable amount of labor and expense also remains in the cutting and manufacturing side, since each garment must be uniquely cut to the dimensions adjusted on each customer. The use of computers can speed up the collection of the information that needs to be transmitted about the adjustments to be made, but the unique cutting requirements are still costly and time-consuming. Even where computers are used to create a scaled pattern based on actual measurements, the costs and time for uniquely cutting to those dimensions usually remain significant.

Materials such as denim, leather, vinyl or fur or others that are difficult to work with, complicate the problem further. If the garment is not cut satisfactorily the first time, it may be prohibitively expensive to adjust it to fit if the customer is dissatisfied with the fit of the actual garment.

Hence, other attempted improvements in the area stem from the use of optical or electrical sensors and a computer to improve accuracy of the measurements. In this type of scheme, the optical or electronic device is used to sense and capture the measurements of a person's body. In one system, the individual wears a special garment having measuring devices that can be "read" by the system. This can be combined with a computer system such as one which creates or scales a special pattern based on such readings. Thus, the measurements can be taken or made interactively and accurately, but each garment must still be cut to the unique dimensions so ascertained.

While this improves accuracy and collection of the custom information, it, too, does not solve the remaining problems and costs of unique cutting and assembly facing the volume manufacturer. Volume manufacturers may make as many as 60,000 or 70,000 pairs of pants a week in factories around the world. Costs have typically been kept low with the use of uniform sizes, which lowers or eliminates the need for specially skilled labor, and specialized, unique cutting and tracking. Custom tailoring done according to the traditional methods is inconsistent with high volume manufacturing and low costs.

Finally, there is a significant subjective element to a sense or feel of fit that varies from customer to customer. For example, two customers whose measurements are exactly the same, may have different tastes regarding looseness or tightness of fit, with one preferring a looser garment and the other a tighter garment. Or, two customers with identical measurements could differ in their style preferences, with one preferring to wear a pair of denim jeans low on the hips and the other higher. In order to conform to a customer's subjective preferences, one or more of the other dimensions may need to be adjusted since they are interrelated. If only objective measurements are used for the custom garment without an actual fitting, these subjective elements may frequently cause a garment constructed only from objective data to be returned by the consumer. A high return or reject rate is costly for both retailers and manufacturers.

SUMMARY

The present invention is a system and method for custom tailoring and manufacturing apparel by using numerous try-on apparels of differing, pre-determined dimensions to make a finished product. A system is used to keep track of the number of try-on apparels and each of their dimensions. As a consumer tries on one of these try-on apparels, a device associated with the system is used to collect the consumer's responses about fit. If one try-on apparel does not fit, the system suggests a next one to try, according to pre-defined rules. When a particular try-on apparel's fit has been approved for purchase by the consumer, this is reported to a manufacturing system, where a piece of apparel corresponding to the dimensions of the approved try-on apparel is cut, stitched, treated, and shipped as a finished apparel.

It is an object of the present invention to provide a method and apparatus for producing custom fitting apparel in volume without the higher costs of traditional custom methods. Apparel manufactured according to the method and apparatus of the present invention can be constructed in volume from one of numerous pre-determined dimensions corresponding to the approved, pre-determined dimensions of a try-on apparel actually selected and tried by a customer.

It is a further object of the present invention to provide retailers and stores with an easily used system for collecting fit information to identify a particular approved try-on apparel to be manufactured and purchased.

It is a feature of the present invention that it allows customers to actually try an apparel on for fit and feel before a custom order is placed.

It is an aspect of the present invention that it permits a manufacturer of custom apparel to optimize use of materials by providing pre-determined dimensions that can be used to cut and manufacture finished apparel. Layouts for the various dimensions can be selected in advance to insure optimal use of fabric, for example, while still providing custom fitting.

It is another aspect of the present invention that it can be implemented in a number of types of systems, from simple manual or electronic devices to computerized systems.

Yet another feature of the invention is its ability to collect approved fit information by customer and convey it to remote manufacturing sites. Using the pre-determined dimensions, or codes corresponding to them, together with ordering and shipping information a retailer can fill orders quickly for items not carried in inventory.

Still another feature of systems constructed according to the present invention is that they use expert system rules. As new types of apparel are considered for manufacture, such as shirts or footwear, for example, rules appropriate to fitting them can be developed and implemented.

BRIEF DESCRIPTION OF THE DRAWINGS

FIG. 7 is a flowchart of the principal logic of a system constructed according to the present invention.

DETAILED DESCRIPTION OF A PREFERRED EMBODIMENT(S)

Figure 1:
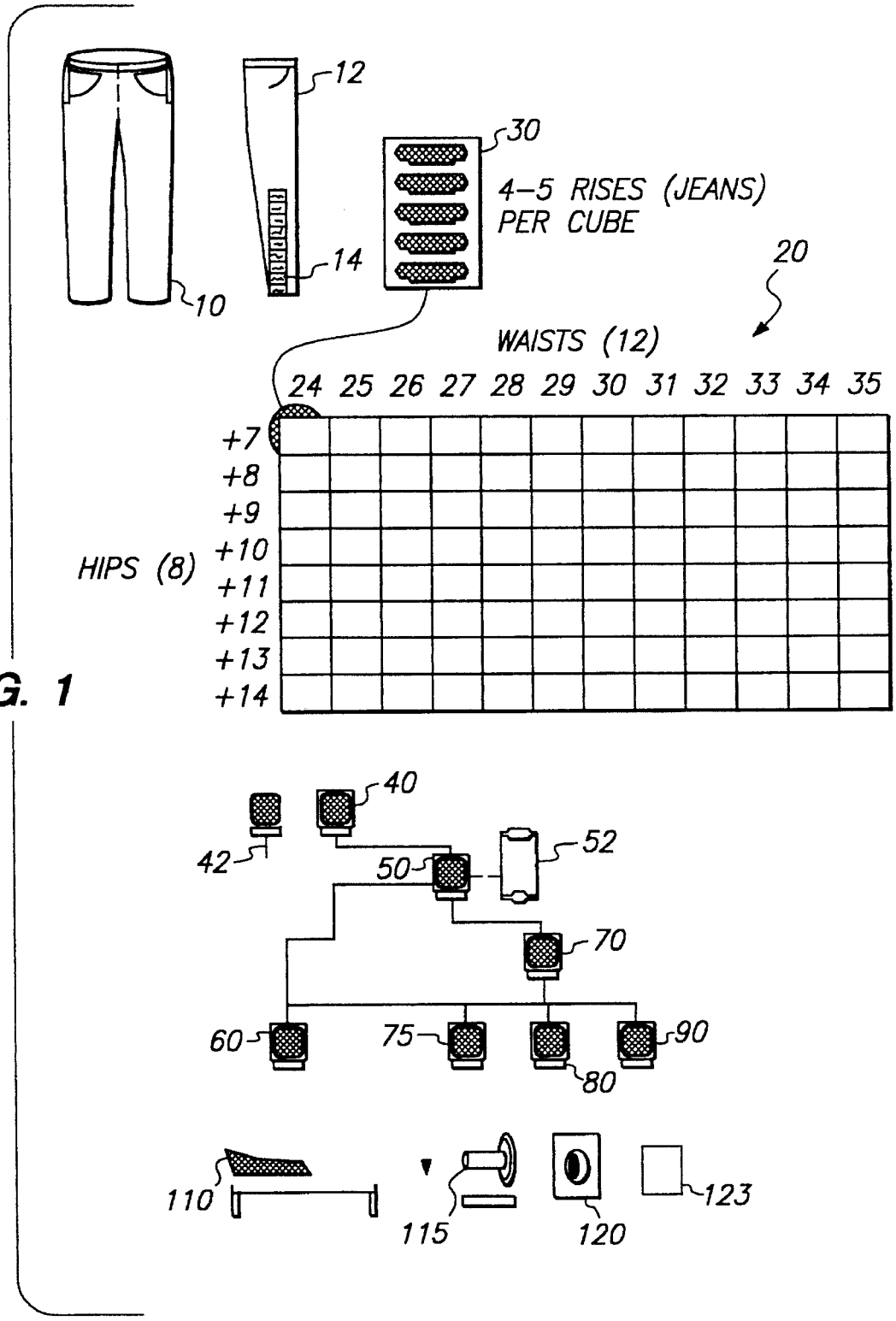
FIG. 1 is an illustrative front and side view of a try-on apparel, shelves containing numerous other try-on apparels, and a system for storing information about them for transmission to a manufacturing system, according to the present invention.

In FIG. 1, a try-on apparel 10 is shown in the form of a pair of women's jeans. As will be apparent to those skilled in the art, any of a number of different types of apparel such as apparel for humans or pets or fitted coverings for furniture or other objects capable of significant variations in dimensions can be made according to the method and apparatus of the present invention.

A side view 12, is shown of try-on apparel 10, bearing a measuring device 14. In a preferred embodiment of the present invention, a considerable number of try-on apparels 10, each having different dimensions from the others are kept at a retail store or site in containers or racks such as shelves 20. For ease of access, each cube 30 of shelves 20 contains a specific number of try-on apparels 10. Here, five different try-on apparels 10 are shown in a cube 30. In this example, nearly 500 try-on apparels, each having dimensions from each of the others are used. In a preferred embodiment, these are not ordinarily used as goods inventory, but are reserved for try-ons.

In a preferred embodiment, try-on apparels 10 are stored in shelves 20 according to gradations in sizes of their dimensions. For example, for women's pants, try-on apparels 10 having a waist size of 24 would be stored in the first column of shelves 20, with each cube 30 holding 5 pairs of the same hip size. Hip sizes increase by an inch for each cube 30 of five try-on apparel 10. Within a cube 30, try-on apparels 10 having five different rise measurements are kept for each particular waist/hip combination in this example. As will be shown, a method of the present invention is used to determine the number of try-on apparels 10 to be made for a store, together with their dimensions for a selected design and configuration of apparel such as women's jeans.

Still in FIG. 1, system 40 is used within a retail store to store the dimensions of each of the try-on apparels 10 in shelves 20. Additional systems or terminals 42 can be used as well. According to the method and apparatus of the present invention, the customer selects try-on apparels 10, and reports fit information to a clerk for entering into system 40. If the first selection does not fit, system 40 recommends the next try-on apparel 10 to try, using the customer's fit information responses. Fit information responses might include a request to make the waist looser, for example. System 40 will use that information to determine which try-on apparel 10 to suggest next. When fit has been approved by the customer, this can be indicated to system 40 and further conveyed to a server 50, having network and other address information stored on disks or other storage devices 52. The exact dimensions of the try-on apparel 10 approved by the customer can then be transmitted on to cutter controller 60.

In one preferred embodiment, cutter controller 60 will contain information about pre-defined patterns for cutting parts of fabric according to the exact dimensions of try-on apparel 10 approved by the customer. Once cut, the fabric can be tracked by manufacturing system 70. Manufacturing system 70 may include several subsystems, such as QA tracking system 80 and shipping system 90. After cutting, the fabric may stitched at stitching station 110, treated at treatment station 120, packaged at station 123 and then shipped to the retail store or directly to the customer by shipping system 90.

Figure 2:
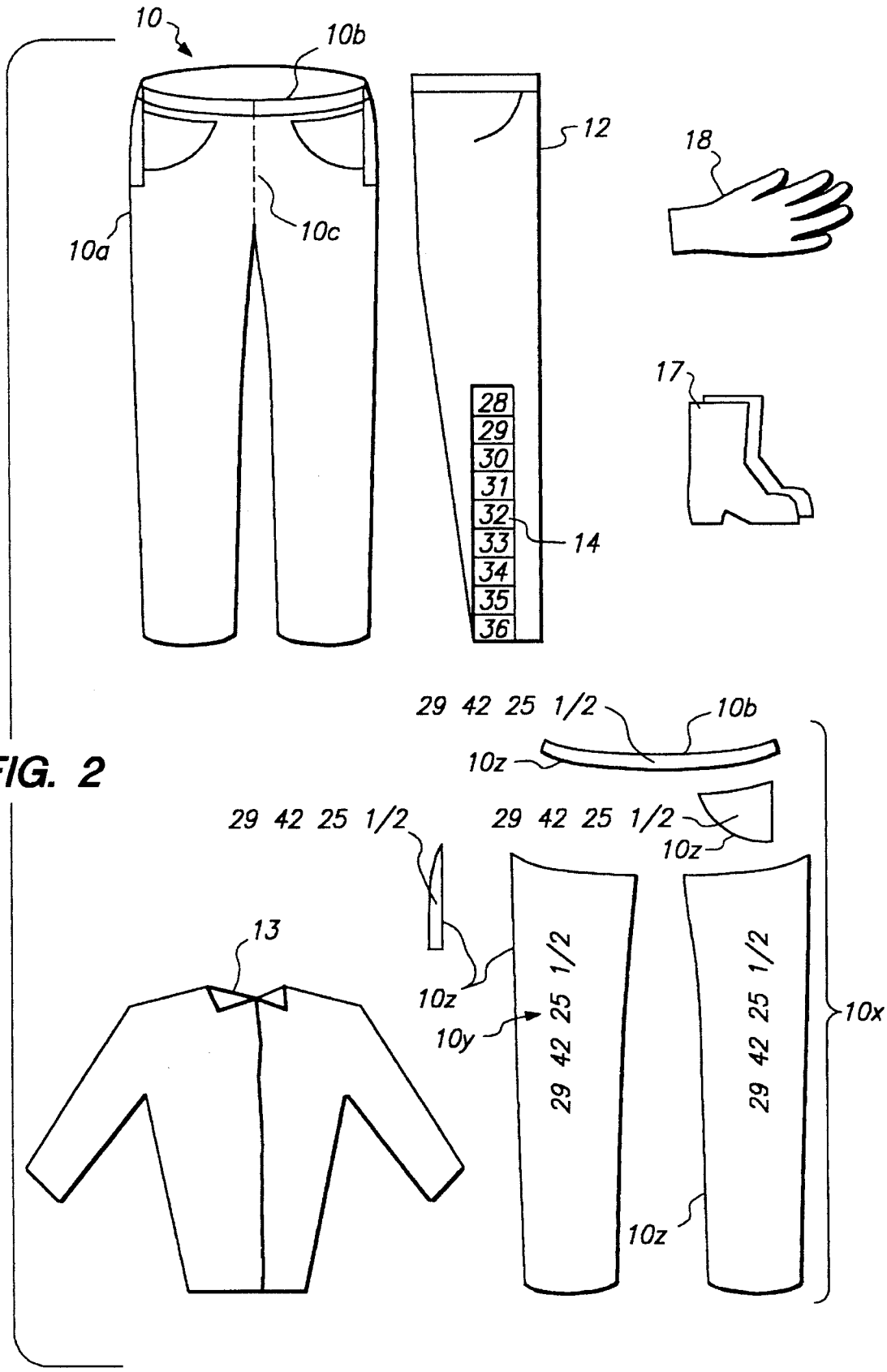
FIG. 2 is a schematic drawing illustrating some types of apparel that can be made using the present invention.

Turning now to FIG. 2, some types of try-on apparel 10, are shown. Try-on apparel 10 is shown here as a pair of women's jeans, having pre-determined hip 10*a*, waist 10*b* and rise 10*c* dimensions. In a preferred embodiment, rise is measured as the distance between the crotch and the waist of a pair of pants or jeans, from front to back. If the rise is shorter, the waist will sit lower on the wearer. If the rise is higher, the waist will be higher on the wearer.

Still in FIG. 2, an apparel of another type of configuration is depicted as shirt 13. Similarly, footwear such as boots 17 or other fitted apparel such as gloves 18 can be made according to the method and apparatus of the present invention.

Again in FIG. 2, a pattern 10*x* is shown having several parts, 10*z*. Each part can be marked with a code 10*y* which corresponds to the same dimensions as a particular try-on apparel 10.

Also in FIG. 2, a side view 12 of try-on apparel 10 is shown, with a measuring device 14 attached to an outer leg. In a preferred embodiment, device 14 is marked with the allowable dimensions for an inseam length for a pair of jeans.

Figure 3:
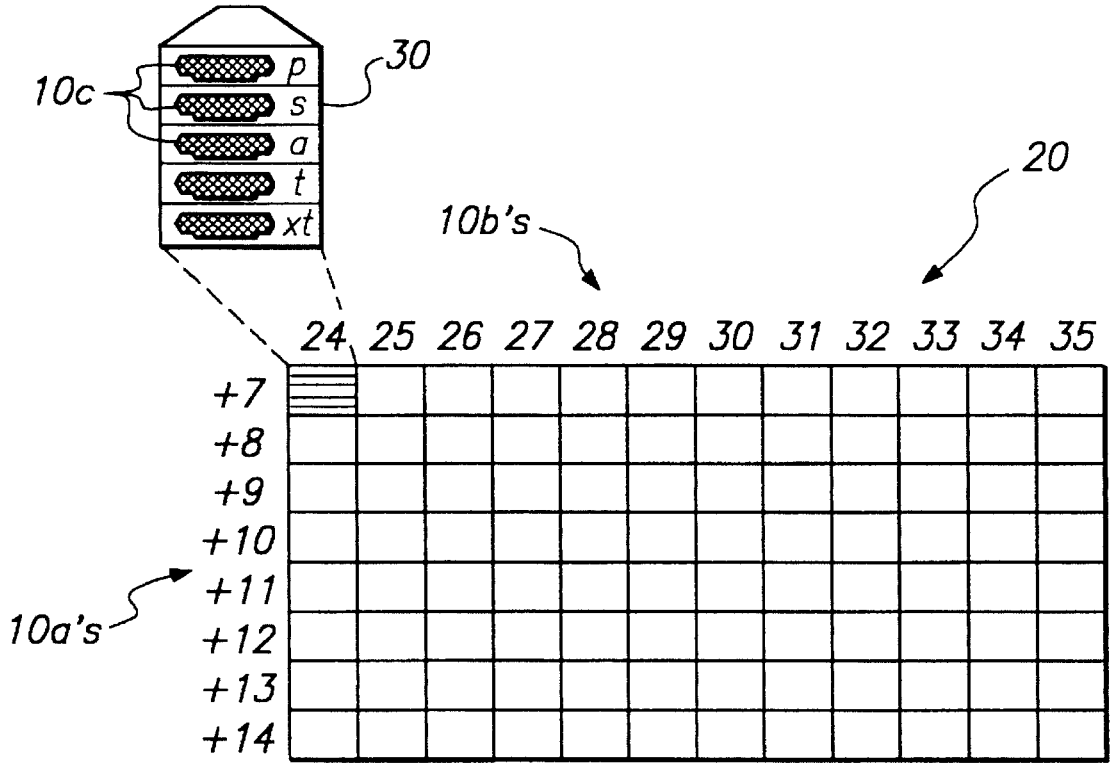
FIG. 3 is a front view of a series of shelves containing try-on apparel.

Turning now to FIG. 3, it can be seen that each cube 30 of shelves 20 contains five try-on apparel 10, all of which have the same hip 10*a* and waist 10*b* measurements, but each having a different rise 10*c* measurement. Thus, in this illustration of a preferred embodiment of the invention, nearly 500 different pairs of try-on apparel 10 are used to determine fit. In a preferred embodiment, for each waist, hip and rise combination, there are at least 9 possible inseam or hem lengths. Thus a matrix of several thousand different body dimension combinations or sizes is used to produce a finished apparel.

Figure 4:
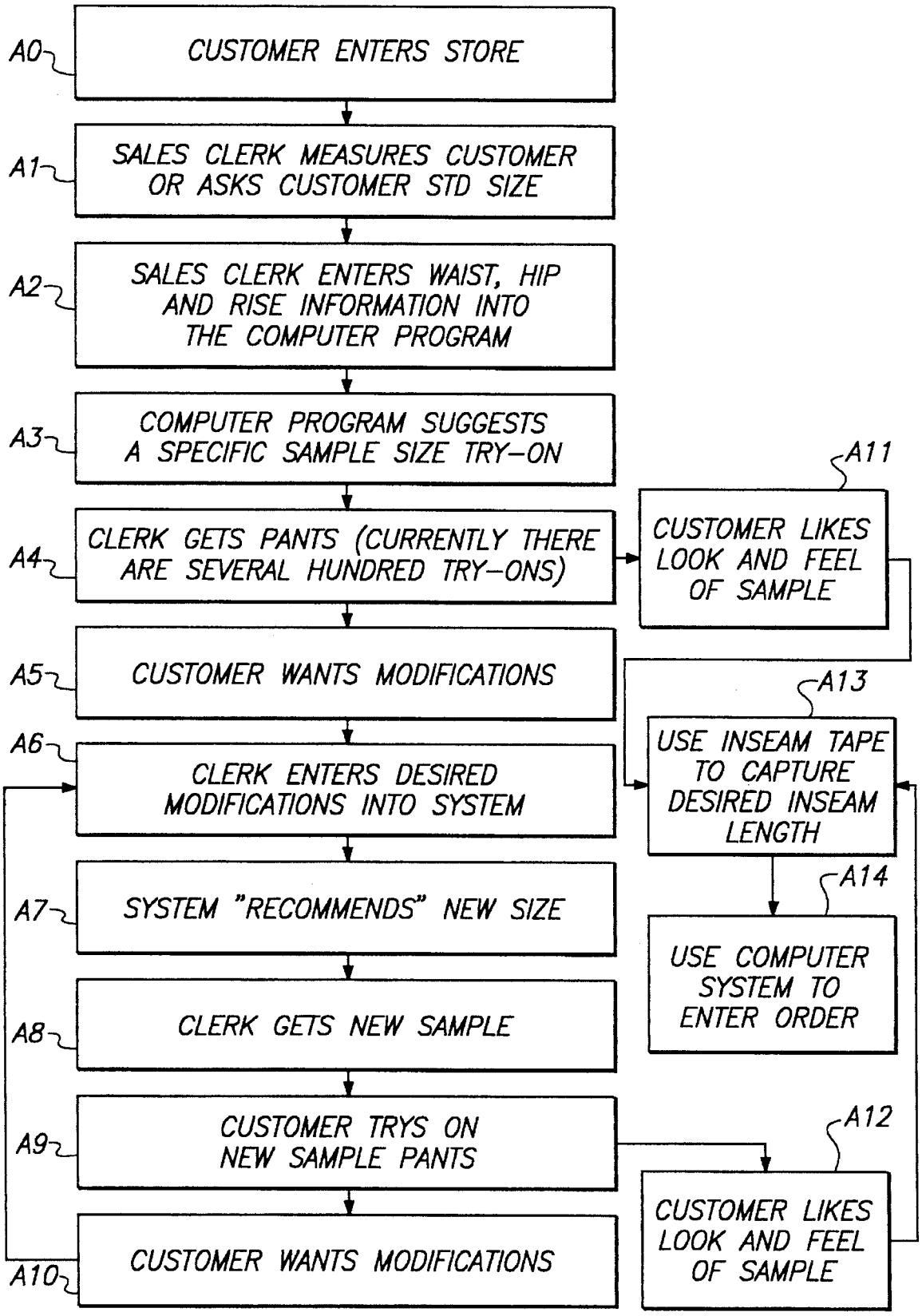
FIG. 4 is a flow diagram depicting the principal steps in the fitting process.

With reference now to FIG. 4, the method and apparatus used to determine fit are shown in a flow diagram of the process at a retail store. After a customer has entered the store, at Step A0, a sales clerk can measure the customer at step A1 or, alternatively, ask the customer his or her standard size. Next, at step A12, the clerk enters hip 10*a*, waist 10*b*, and rise 10*c* information into the system, using the data collected from the customer. At step A3, the system will suggest a specific try-on apparel 10 to try on. In the situation where there are several hundred or thousands of try-ons, the clerk typically gets the specific try-on apparel 10 suggested by the system shown here as step A4. After the customer tries this try-on apparel 10, if he or she likes the fit and feel of try-on apparel 10 as indicated at step A11, the clerk proceeds to step A13 to capture information about hem lengths or inseam tape measurements and then enters an order into the system at step A14.

Still in FIG. 4, if the customer wants modifications, as illustrated at step AS, such as a looser waist or hips or a higher or lower rise, these modifications are indicated to the system at step A6 by the clerk. Using pre-determined rules the system recommends at step A7, a new try-on apparel 10 to try, having dimensions that more closely approximate those indicated as desirable. The clerk gets the new try-on apparel 10 at step A8, and the customer tries that on at step A9. If the customer likes the fit and feel of that try-on apparel 10 (step A12), steps A13 and A14 are taken. If not, and the customer wants additional modifications, as shown at step A10, steps A6 through A10 are repeated until the customer either approves a try-on apparel 10, or decides not to purchase (DNP).

Figure 5:
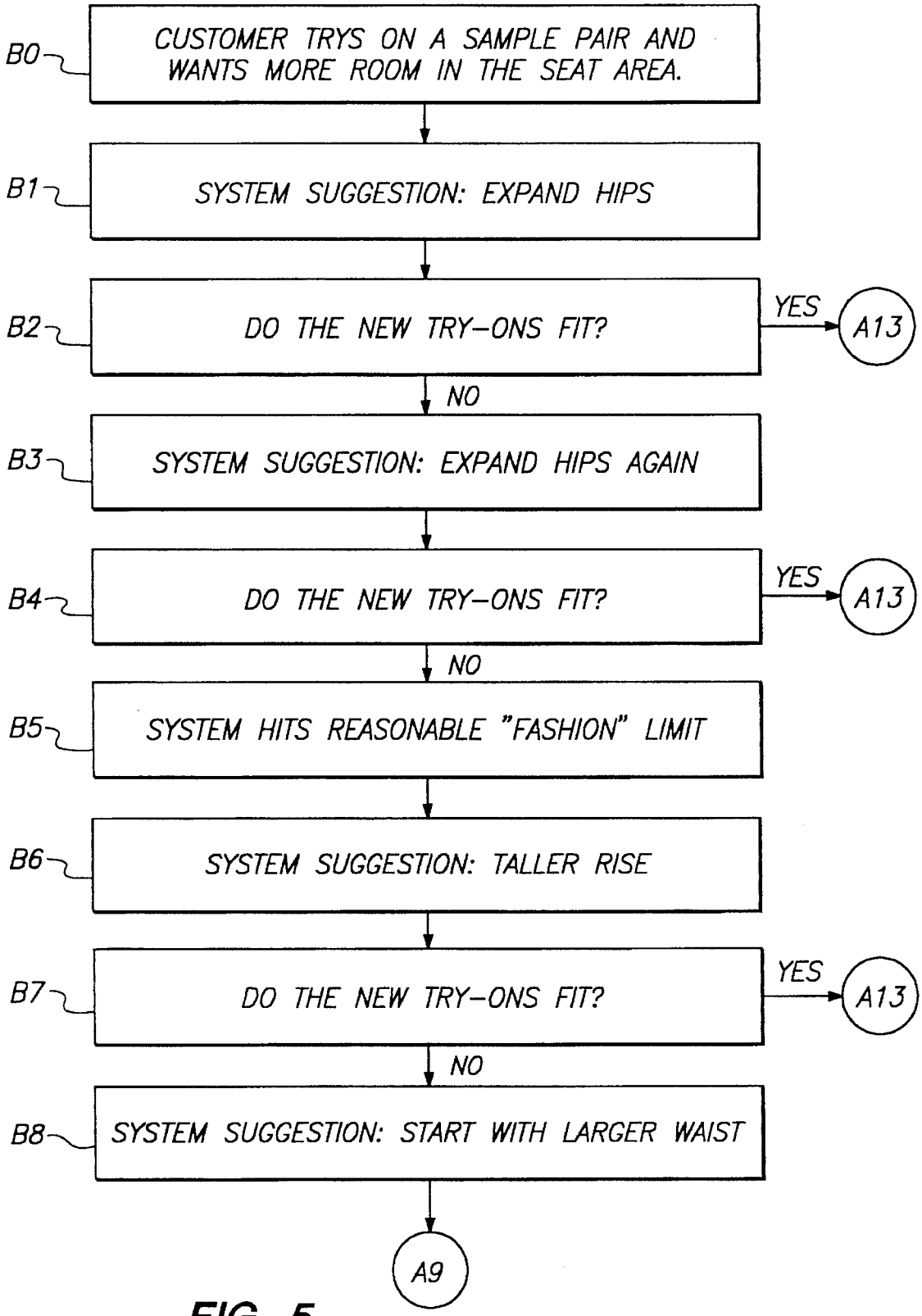
FIG. 5 is a flow diagram illustrating detailed steps of part of the fitting process.

In FIG. 5, a more detailed view of the operation of some of the steps of the present invention is shown in a flow diagram. Here, at step B0, a customer has tried on a try-on apparel 10 that is a pair of pants and wants more room in the seat area. Using pre-determined rules, the system suggests expanding hip 10*a* measurements at step B1. If this new try-on apparel 10 fits (Step B2), the clerk proceeds to step A13 in previous FIG. 4 to collect additional information.

Back in FIG. 5, if the new try-on apparel 10 does not fit, the system suggests expanding hip 10*a* measurements again and will suggest yet another try-on apparel 10, having these new dimensions at step B3. At step B4, the fit of this try-on apparel 10 is checked. If it does not fit, the system proceeds to step B5 to see if there is a reasonable fashion limit. For example, while hundreds or thousands of garments can be defined by the present invention, a particular manufacturer may decide that it is not economically feasible to try to sell garments having certain dimensions. These fashion limits can be included in the system. The system may suggest an alternate set of try-on apparel 10 such one having a taller rise 10*c*, as indicated at step B6. It is possible that that or a larger waist 10*b*, as could be suggested at step B6, might suggest a try-on apparel 10 that will fit the customer but stay within the fashion limits imposed by the manufacturer. If the new try-on apparel 10 fits, (Step B7) the system instructs the clerk to go to Step A13. If not, another suggestion may be made at step B8, namely start with larger waist.

Figure 6:
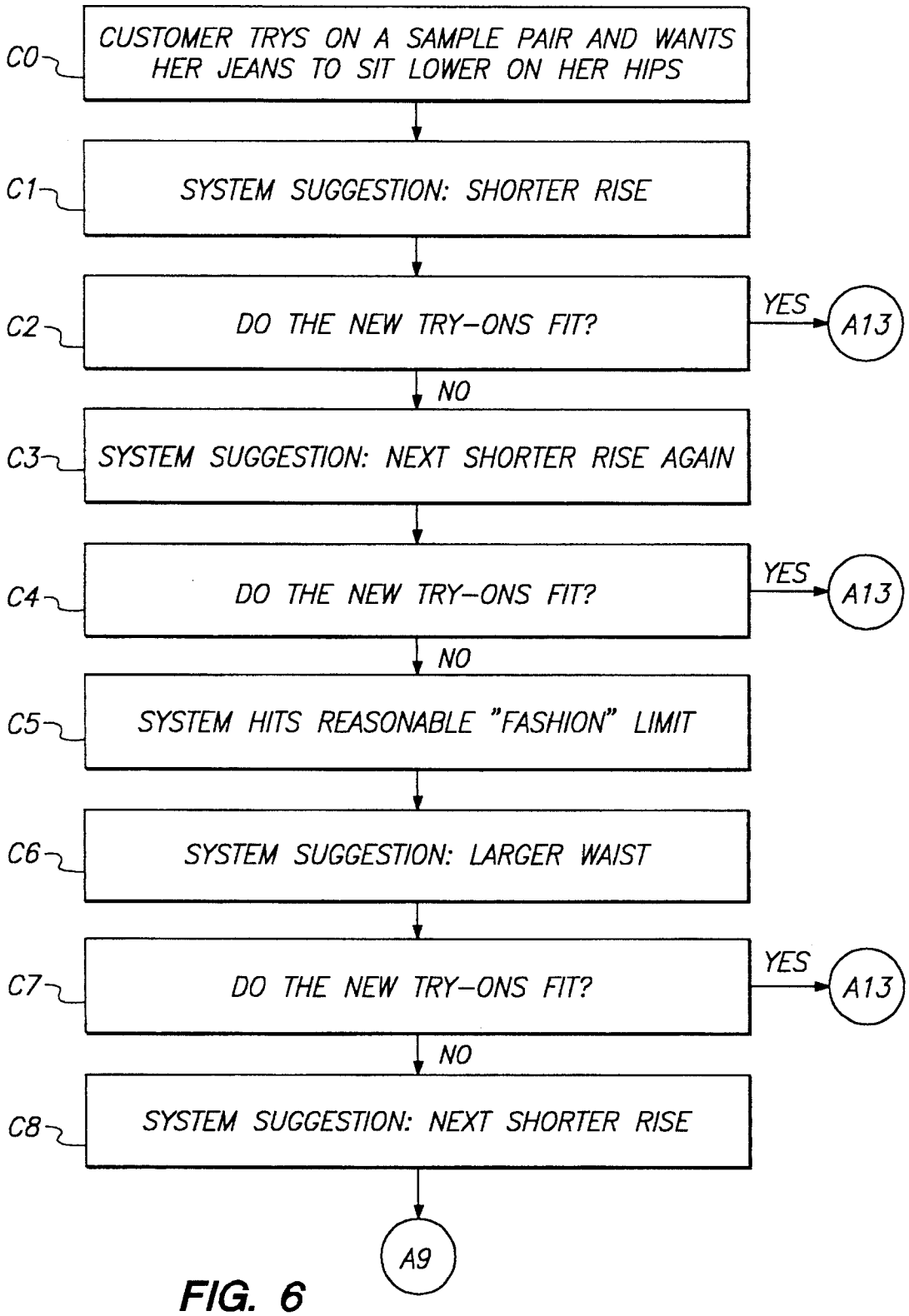
FIG. 6 is a flow diagram showing another example a possible detail step of the fitting process.

In FIG. 6, another set of variations in the process is shown in which the customer wants her jeans to sit lower on her hips (step C0). The present invention will suggest a shorter rise, first at Step C1, and continue until a fashion limit is reached at step C5. If the try-on apparel 10 still does not fit, the system will suggest a larger waist, as shown at Step C6. Processing continues until a fit is approved or the customer decides not to purchase.

With reference now to FIG. 7, an overall flow diagram of the logic of a preferred embodiment is shown. Assuming the customer tries on a pair of try-on apparel 10 at step D0, the sytem checks for fit at D1. If that try-on apparel 10 fits, and the customer wants to order, the order is taken at step D2. If that apparel does not fit, the system checks to see if the waist dimension was approved by the customer at D3. If not, a next check is made to see if a waist fashion limit has been reached at step D4. If yes, the system will check to see if either a different hip 10*a* or rise 10*c* suggestion is possible at step D5. If so, a different try-on apparel 10 will be suggested. If not, no other options appear possible and the system proceeds to DB to collect did not purchase information at step 16.

Note that as the system determines that options are no longer available in one or more of the dimensions, these choices are disabled so that the user cannot select them.

Still in FIG. 7, if a waist limit was not reached, the processing proceeds to Step D7, to see if the hip 10*a* dimensions were approved. Processing similar to that described for the waist dimensions takes place at steps D8, D9 and D10. If dimension choices are still possible, the system will ask if the rise 10*c* of the current try-on apparel 10 is approved at Step D11. If not, limits and remaining choices are checked at steps D12 and D13. The system continues to disable those options that it has determined are no longer available.

Finally, still in FIG. 7 at Step D15, the system checks to see if any dimension options can still be suggested, if a try-on apparel 10 has still not been approved. If some remain, the system proceeds to step D17, to suggest one and the customer may try that one.

Figure 8:
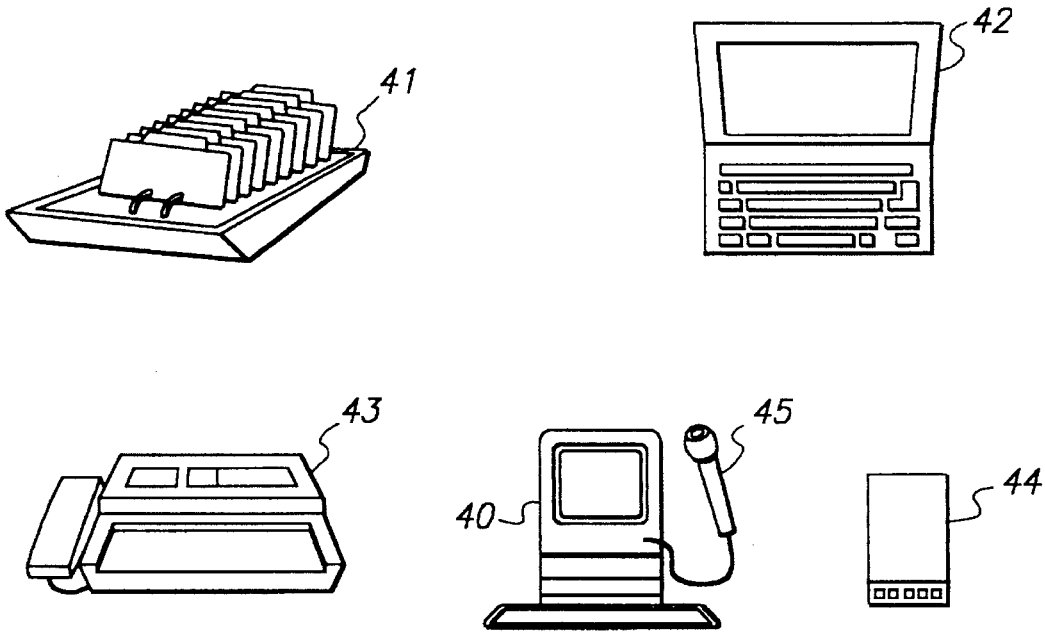
FIG. 8 is an illustrative front perspective view of some possible embodiments of a system constructed according to the present invention.

Turning now to FIG. 8, it will be apparent to those skilled in the art that the method and apparatus of the present invention can be implemented in a variety of ways. For example, a manual system might use a cardfile 41, together with an instruction manual or sheet to go through the logic illustrated in the previous figure. Alternatively, an electronic device 42, such as a dedicated palmtop device similar to a pre-programmed electronic calculator could be used. Either of these might be used in conjunction with a fax machine 43 or a modem 44 to convey the fit information to a manufacturing system.

Still in FIG. 8, a voice-activated system or device 45 could be connected to a computer system 40 to implement the invention.

Figure 9:
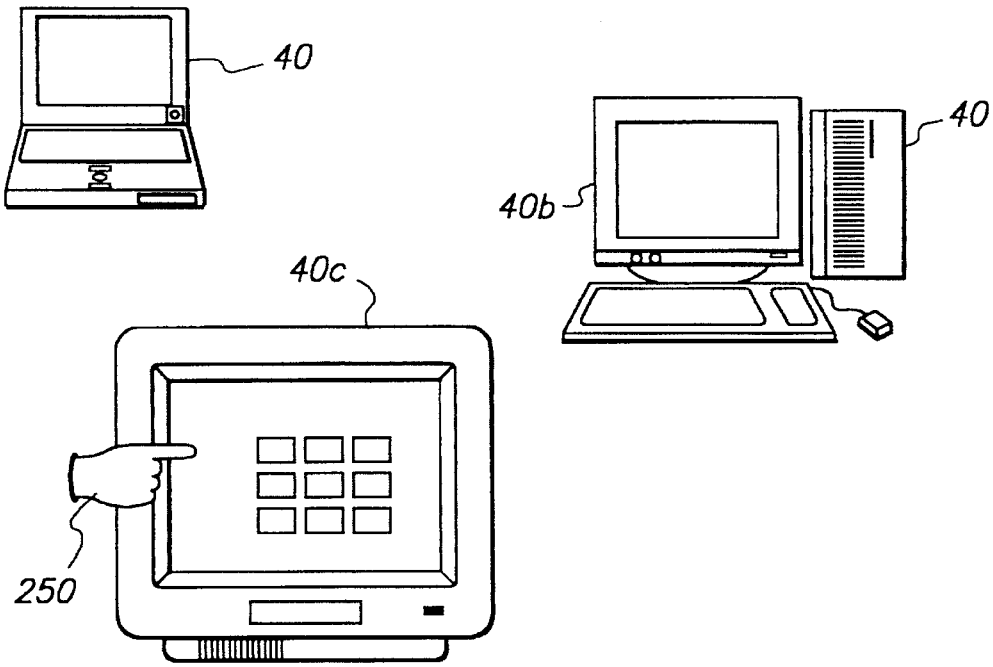
FIG. 9 is a front perspective view illustrating some types of input devices.

Turning now to FIG. 9, a preferred embodiment of the present invention using an interactive touchscreen 40*c* is shown. A simpler display device 40*b* could also be used with a keyboard. In a preferred embodiment a touchscreen 40*c* is coupled to a system 40 and a keyboard. In a preferred embodiment, an industry standard personal computer system is used with a touch sensitive display and keyboard. The personal computer is programmed in Visual Basic to create the easy to use interface, but as will be apparent to those skilled in the art, any of a number of computer systems such as laptops, mainframes, mini-computers, parallel processors, neural nets and so on could be used. Similarly, any of a number of programming languages exist which permit one to create a graphical user interface or a voice interface or other interface that is simple and easy for either a clerk or a customer to use. A preferred embodiment stores and accesses the dimension information in a matrix or table to access it. The logic flows depicted above can be implemented in any of a number of ways to access such information, including software, firmware, hardware and so on.

Figure 10:
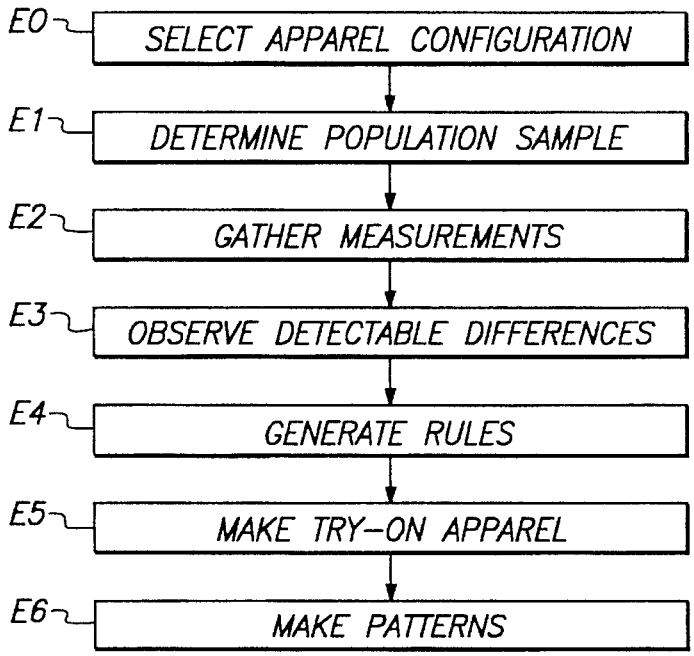
FIG. 10 is a flow diagram of the steps used to determine the dimensions to use to construct try-on apparel, the number to make and the rules for trying them.

With reference now to FIG. 10, the method used by the present invention to determine quantities and dimensions of try-on apparels 10 is shown. The flow diagram indicates that an apparel design and configuration is chosen at Step E0. In a preferred embodiment, this configuration is women's jeans. But it will be clear to those in the art that shirts, gloves, footwear or any other type of fitted apparel could be selected.

Next, at Step E1, a population sample is chosen. The size of this will depend on the type of apparel configuration selected. In a preferred embodiment, approximately 1300 individual measurements were used. At Step E2, these measurements are gathered either from individuals who are being measured for the first time, or, if any databases exist that may be relevant, from those.

In a preferred embodiment, actual measurements are taken from at least a subset of the sample, so that an expert can observe what differences in dimensions these individuals are likely to detect. For example, In a preferred embodiment, it was found that women who tried on jeans of different dimensions, were usually not able to detect differences of less than an inch in waist 10*b* or hip 10*a* dimensions. However, most women measured were able to detect differences as small as half an inch for rise 10*c* dimensions. These observations are made at Step E3 and used in Step E4, together with any relevant information about fashion limits to generate rules for selecting try-on apparels 10 at Step E4. The information is also used to decide at Step E5 how many try-on apparels 10 to make, and at Step E6, how many patterns, if any.

It should be noted that while patterns are used with the try-on apparels 10*n* a preferred embodiment, it is possible that other apparel such as molded or formed try-on apparels 10 may not require patterns.

Figure 11:
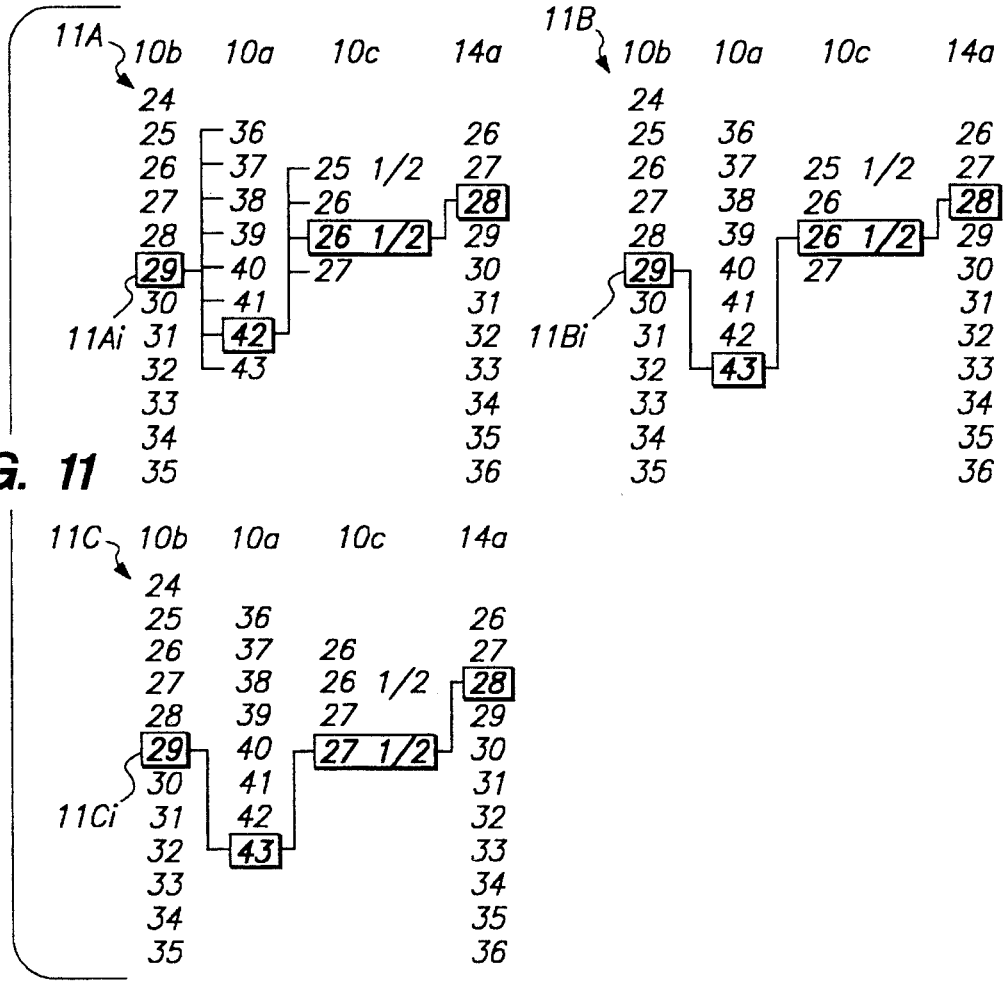
FIG. 11 shows three examples of dimensions considered in a hypothetical fitting.

Now turning to FIG. 11, an illustration is given of the selection process according to the method and apparatus of the present invention. In charts 11A, 11B and 11C, waist 10*b*, hip 10*a* and rise 10*c* dimensions for a pair of jeans are shown, together with possible inseam or hem lengths 14*a*.

The examples shown in FIG. 11 are the ones illustrated from the perspective of the clerk operating a device associated with the system in the following FIGS. 12 through 17.

Figure 12:
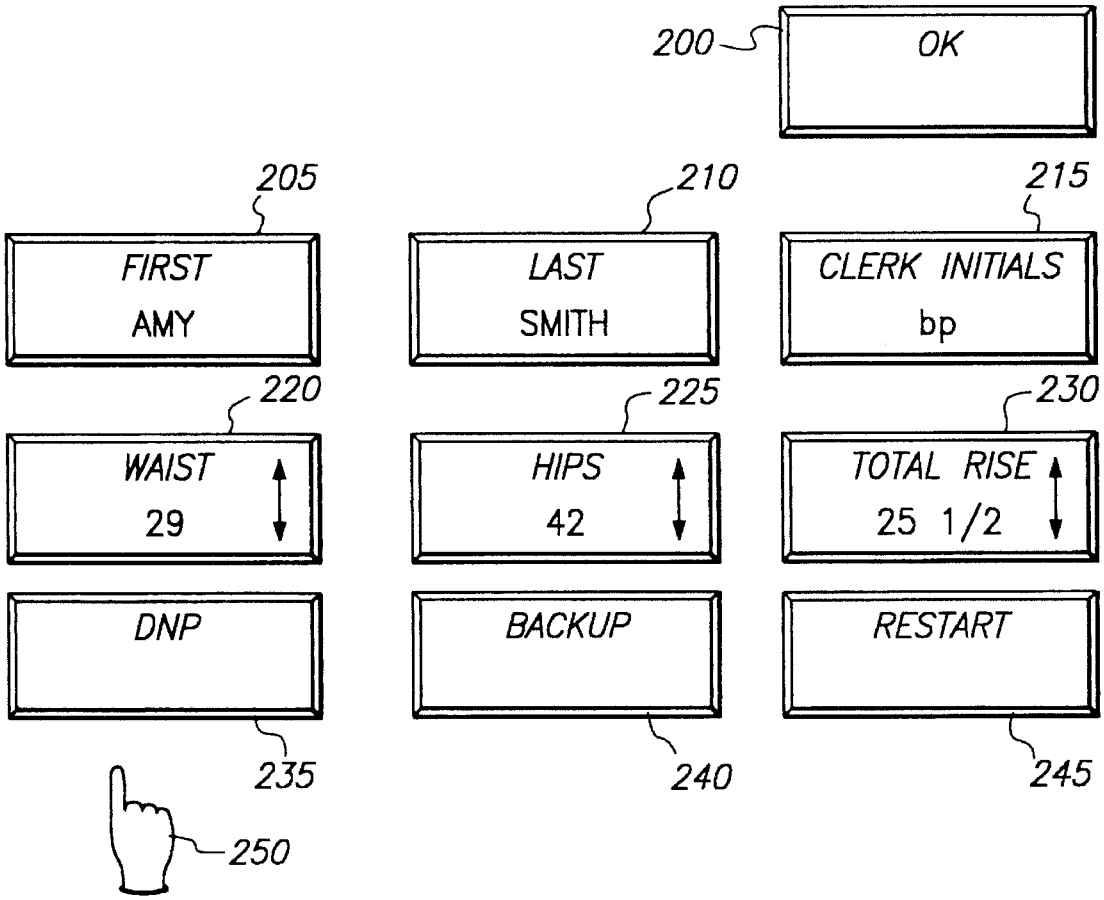
FIG. 12 is a schematic view of a touchscreen interface of a device used to collect fit information according to the present invention, depicting a beginning screen.

Turning to FIG. 12, where a touchscreen of a preferred embodiment is shown, a number of "button" options are depicted. Buttons 205, 210 and 215 indicate the clerk has entered a prospective buyer's name (Amy Smith) and the clerk's initials (bp).

In one preferred embodiment of the invention, the clerk measures the customer and enters her dimensions, here shown as Button 220 with a Waist value of 29, Button 225 with a hip measure of 42 and Button 230 with a rise of 25½.

Button 235 can be used to indicate the customer did not purchase anything. Button 240 can be selected to backup to a previous screen and Button 245 can be used if the clerk wishes to restart.

Figure 13:
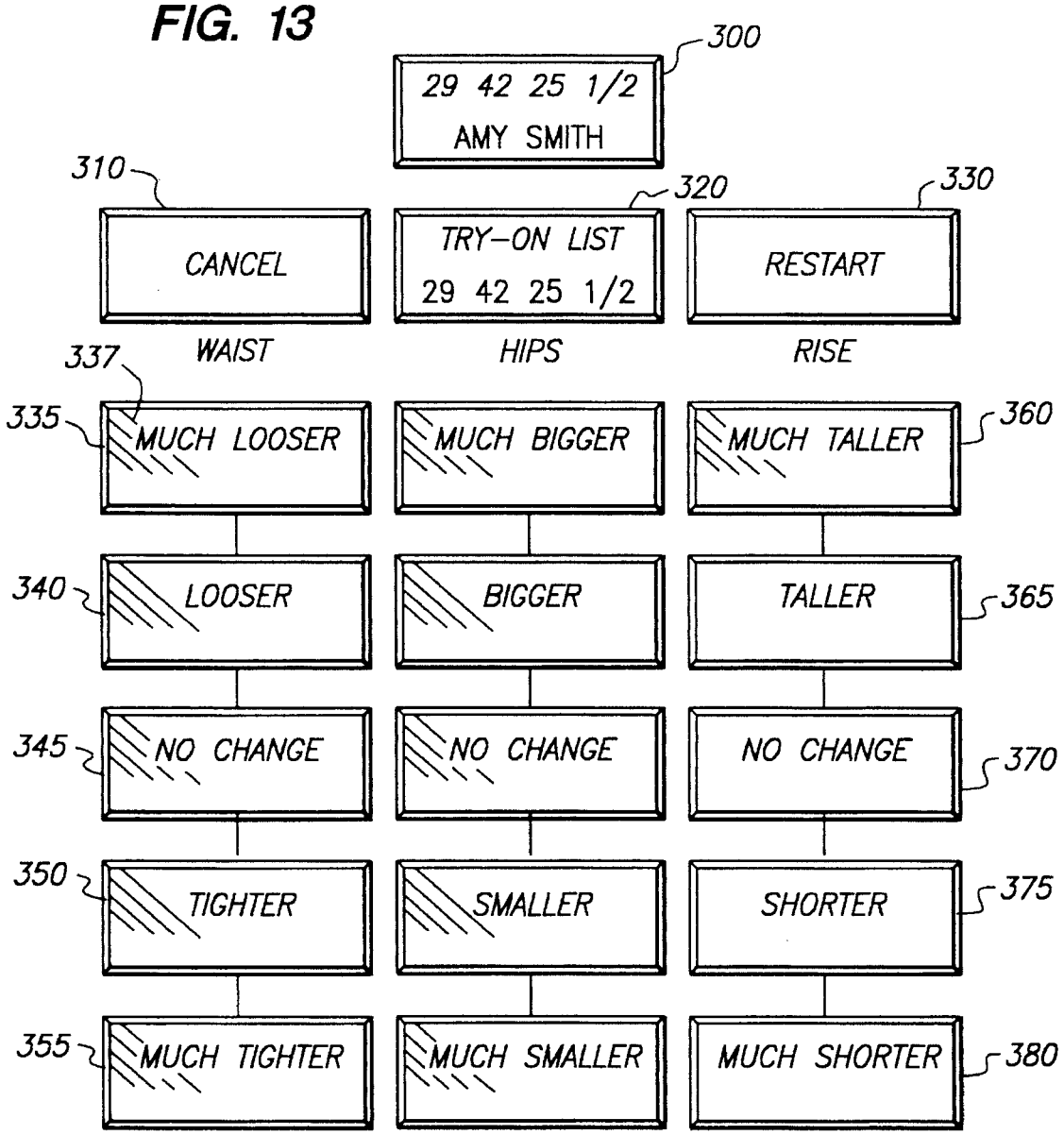
FIG. 13 is a schematic view of a touchscreen interface of a device used to collect fit information according to the present invention, depicting a screen showing options eliminated by a prospective buyer's fit responses.
Figure 14:
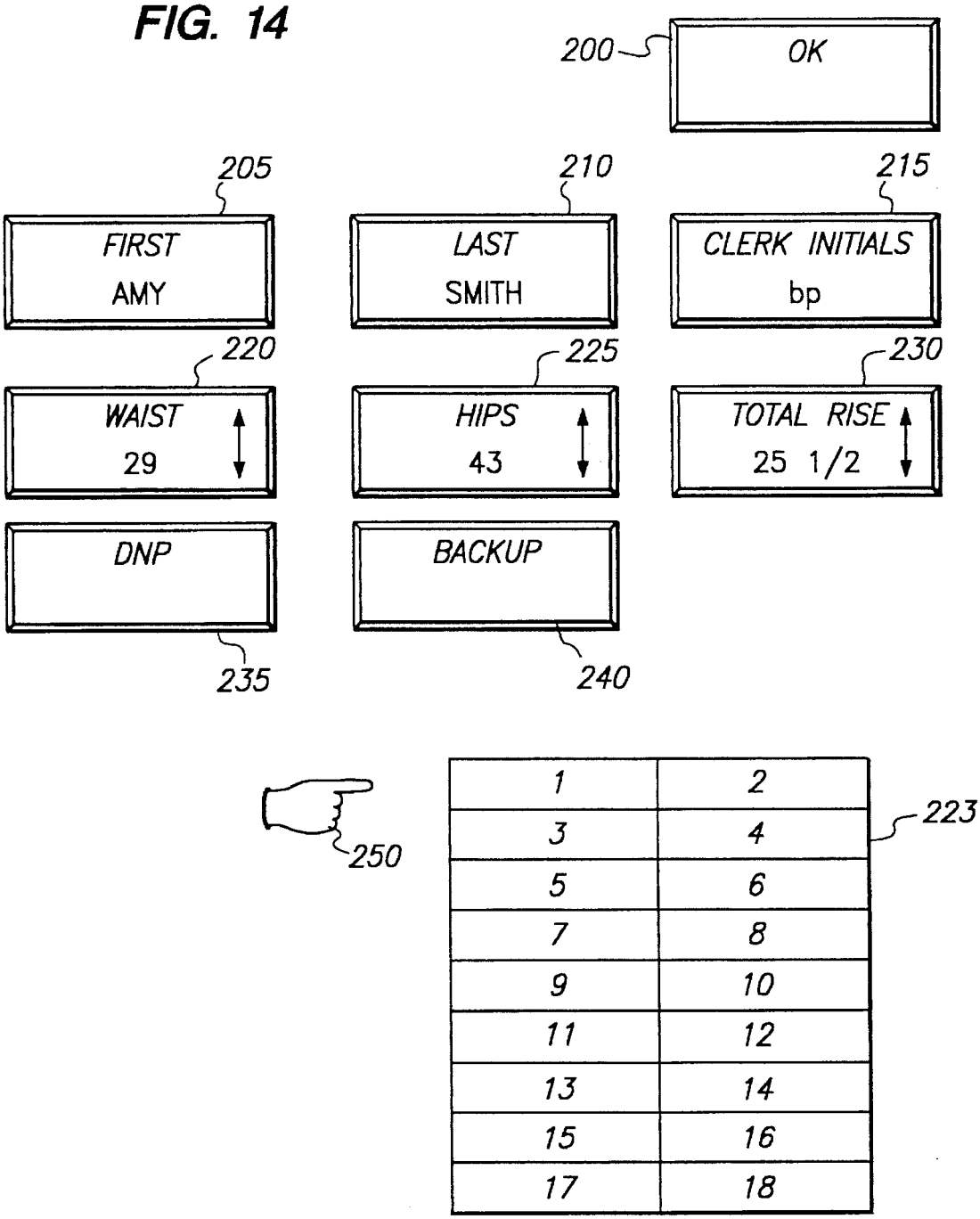
FIG. 14 is a schematic view of a touchscreen interface of a device used to collect fit information according to the present invention, depicting an alternative way of entering initial dimensions information.

Now in FIG. 13, a screen is shown with Button 300 displaying the measurements taken for the customer and a try-on apparel 10 list 320, showing a try-on apparel 10 that has been suggested. (FIG. 14 shows an alternate way of entering dimensions if no measurements are taken. Either the clerk or the prospective buyer can enter the buyer's standard size from a table 223. The size chosen is translated by the system into the dimensions of a try-on apparel 10 to suggest.

Returning to FIG. 13, buttons having shaded portions 337 are shown. These dimension options or choices have been disabled by the system, after the customer has reported that some of the dimensions do not fit. Those Buttons 360–380 that have no shaded portion, are the remaining options.

Figure 15:
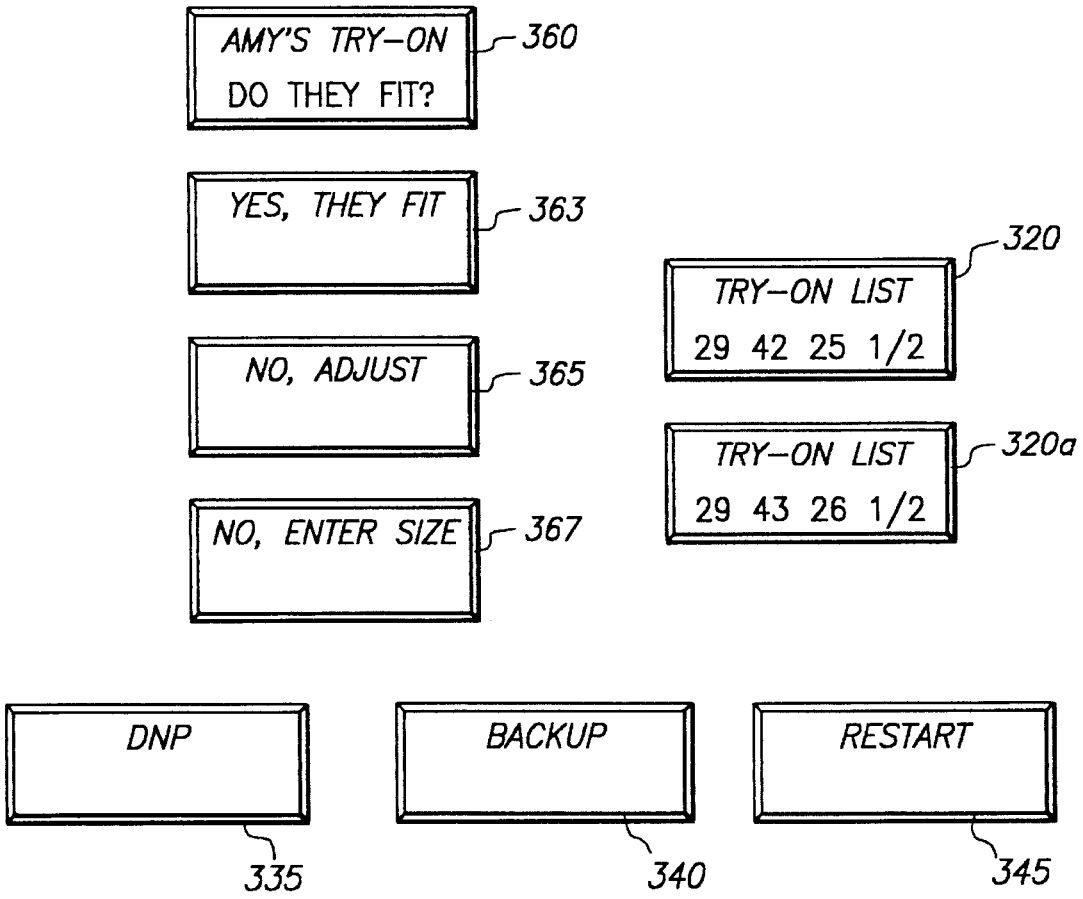
FIG. 15 is a schematic view of a touchscreen interface of a device used to collect fit information according to the present invention, depicting the results from two try-ons.
Figure 16:
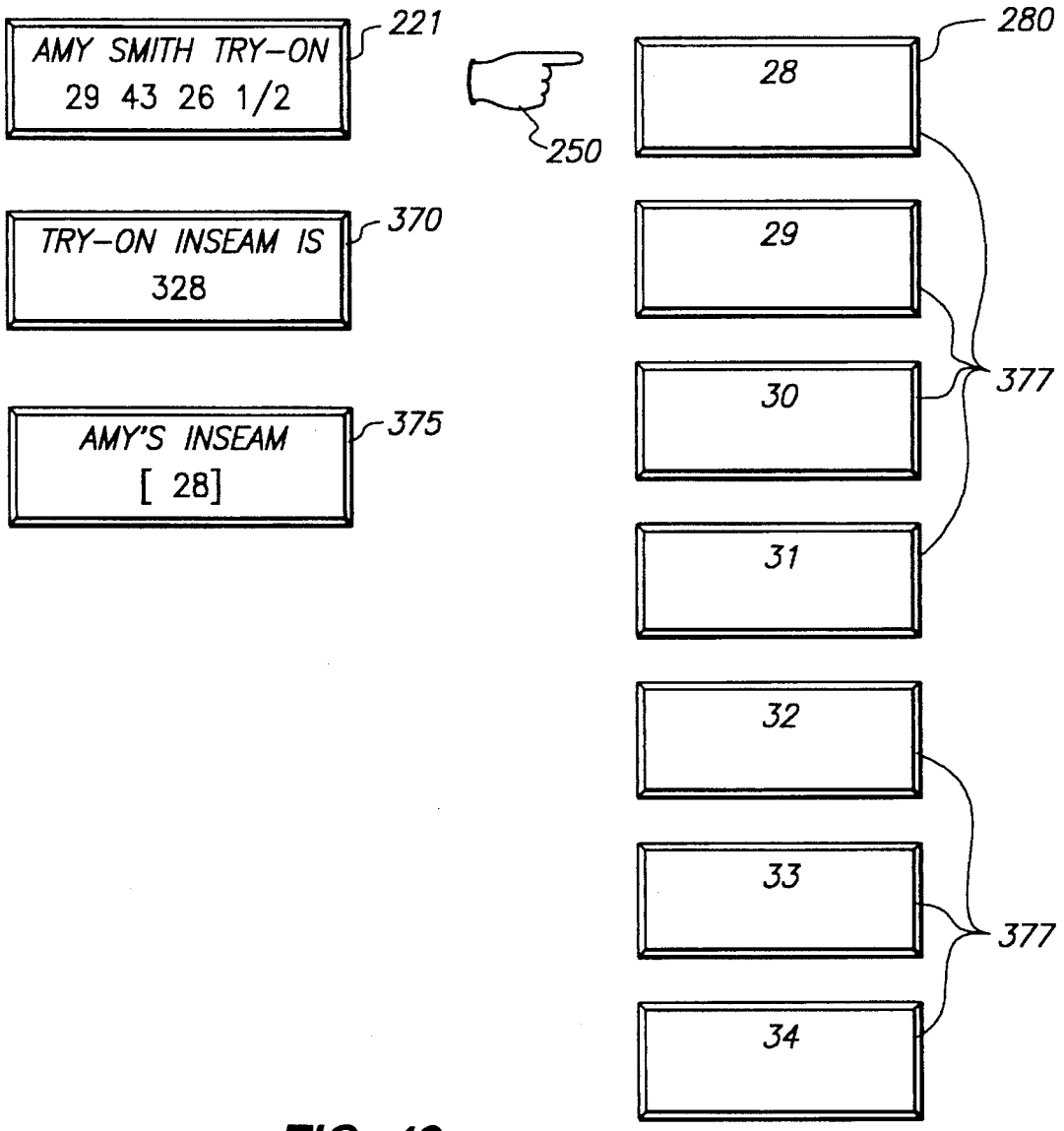
FIG. 16 is a schematic view of a touchscreen interface of a device used to collect fit information according to the present invention, depicting hem length options of a selected try-on apparel.

FIG. 15 shows the screen options presented after a try-on apparel 10 has been tried. FIG. 16 illustrates incorporating the inseam or hem length measurements, after a try-on apparel 10 has been selected. Here, the customer wants inseam 28 in Button 280.

Figure 17:
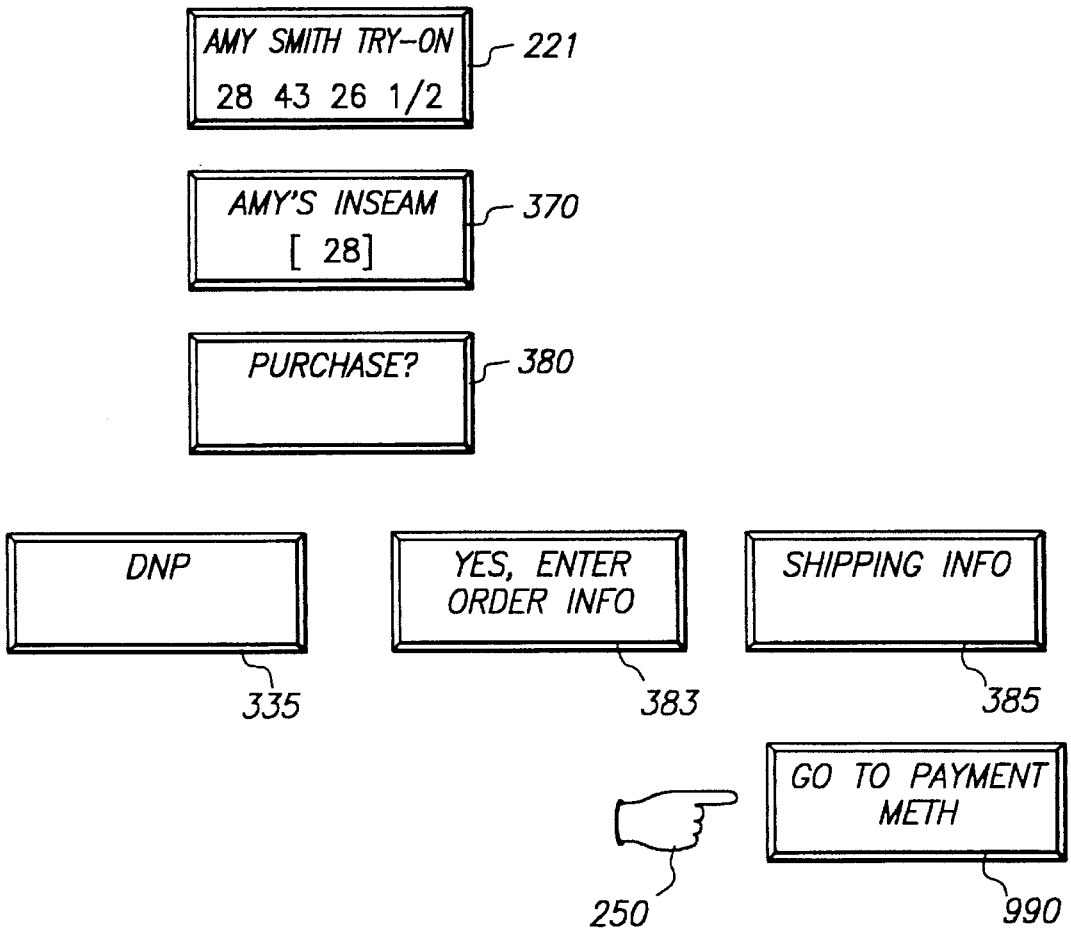
FIG. 17 is a schematic view of a touchscreen interface of a device used to collect fit information according to the present invention, depicting final approval and purchase options.

FIG. 17 shows a screen that can be used after all dimensions have been approved. If the customer wants to order, Button 383 is pressed, to call up order information screens, if desired. Button 385 can be used to call up screens for shipping information for use by the manufacturing system.

And, still in FIG. 17, payment methods can be selected at Button 990. Those skilled in the art will appreciate that the embodiments described above are illustrative only, and that other systems in the spirit of the teachings herein fall within the scope of the invention.

What is claimed is:

1. An apparatus for custom tailoring and manufacturing apparel of a selected design and configuration, comprising:

a plurality of try-on apparels, each try-on apparel having pre-determined dimensions differing from the dimensions of each other try-on apparel;

a system for storing and accessing said pre-determined dimensions of each of said try-on apparels and for entering fit information from a prospective buyer regarding those try-on apparels actually tried on by such buyer;

a device associated with said system for collecting the relative fit information of each of said plurality of try-on apparels actually tried on by a prospective buyer and reporting said fit information for identifying final approved pre-determined dimensions for manufacturing.

2. The apparatus of claim 1 wherein each of said plurality of try-on apparel bears a code indicating its pre-determined dimensions.

3. The apparatus of claim 2 further comprising a plurality of patterns, each of said patterns corresponding to one of said plurality of try-on apparels and bearing its code.

4. The apparatus of claim 3 wherein each of said plurality of patterns include parts suitable for assembling into said selected design and configuration, each part bearing a code corresponding to each of said plurality of patterns.

5. The apparatus of claim 1 wherein said system includes rules for suggesting one of said plurality of try-on apparels to use to determine acceptable fit.

6. The apparatus of claim 4 wherein materials cut to correspond to said parts bear said code corresponding to one of said plurality of patterns.

7. The apparatus of claim 1 wherein said selected design and configuration comprises women's pants.

8. The apparatus of claim 1 wherein said selected design and configuration comprises footwear.

9. The apparatus of claim 1 wherein each of said plurality of try-on apparels includes a measuring device attached to an edge of each of it, said measuring device having an adjustable hem length,whereby said edge can be turned up and measured by said measuring device for capturing a desired hem length.

10. An apparatus for custom tailoring and manufacturing apparel of a selected design and configuration, comprising:

an electronic device for storing and accessing dimension information, said electronic device having a communications capability, and a capability for entering fit information from a prospective buyer regarding those try-on apparels actually tried on by such buyer;

a plurality of try-on apparels, each try-on apparel having pre-determined dimensions differing from the dimensions of each other try-on apparel, said pre-determined dimensions being stored in said electronic device for each of said try-on apparels;

an indicator device associated with said electronic device for collecting the relative fit information of each of the predetermined dimensions of those try-on apparels actually tried on by a prospective buyer and reporting said fit information for identifying final approved pre-determined dimensions for manufacturing.

11. The apparatus of claim 10 wherein each of said plurality of try-on apparel bears a code corresponding to its dimensions.

12. The apparatus of claim 11 further comprising a plurality of patterns, each of said plurality of patterns corresponding to one of said plurality of try-on apparels, for manufacturing a selected design and configuration.

13. The apparatus of claim 12 wherein each of said plurality of patterns include parts suitable for assembly into a selected design and configuration, each part bearing a code corresponding to one of said plurality of patterns.

14. The apparatus of claim 13 wherein materials cut to correspond to said parts bear said code.

15. The apparatus of claims 10 wherein said electronic device includes logic responsive to the entered fit information for suggesting one of said plurality of try-on apparel of different dimensions to use to determine acceptable fit.

16. The apparatus of claim 10 wherein said each of said plurality of try-on apparel includes a measuring device attached to an edge of each of it having an adjustable hem length, whereby said edge can be turned up and measured by said measuring device for capturing a desired hem length as part of said fit information.

17. An apparatus for custom tailoring and manufacturing apparel of selected design and configuration, comprising:

a computer system having expert system rules for storing and accessing dimension information, said computer system having a communications capability;

a plurality of try-on apparels, each of said plurality of try-on apparel having pre-determined dimensions differing from the dimensions of each other of said plurality of try-on apparel, said pre-determined dimensions being stored in said computer system for each of said plurality of try-on apparel;

an indicator device associated with said computer system for collecting the relative fit information of each of the predetermined dimensions of those try-on apparels actually tried on by a prospective buyer and reporting said fit information for identifying final approved pre-determined dimensions for manufacturing.

18. The apparatus of claim 17 wherein each of said plurality of try-on apparel bears a code corresponding to its dimensions.

19. The apparatus of claim 18 further comprising a plurality of patterns, each of said plurality of patterns corresponding to one of said plurality of try-on apparels, for manufacturing a selected design and configuration.

20. The apparatus of claims 18 wherein each of said plurality of patterns include parts suitable for assembly into a selected design and configuration, each part bearing a code corresponding to one of said plurality of patterns.

21. The apparatus of claim 20 wherein materials cut to correspond to said parts bear said code.

22. The apparatus of claim 17 wherein said expert system rules are derived from empirical analysis of actual use of prototypes of said plurality of try-on apparels, together with measurements to determine the number of try-on apparels to make and their dimensions.

23. The apparatus of claim 17 wherein said expert system rules limit incremental changes in dimensions of said plurality of try-on apparels to those detectable by prospective buyers.

24. The apparatus of claim 17 wherein said expert system rules limit the number of try-on apparels to recommend to a prospective buyer according to pre-determined constraints.

25. The apparatus of claim 17 wherein said expert system rules disable dimensional choice options during processing as those dimensional choice options no longer apply to those of said plurality of try-on apparel likely to fit.

26. The apparatus of claim 17 wherein said indicator device is interactive.

27. The apparatus of either of claims 10 or 17 wherein said indicator device comprises a display screen coupled to a keyboard.

28. The apparatus of either of claims 10 or 17 wherein said indicator device comprises a touchscreen display.

29. The apparatus of either of claims 10 or 17 wherein said indicator device comprises a voice activated system.

30. The apparatus of either of claims 10 or 17 wherein said indicator device is controlled by an easy to use interface.

31. The apparatus of either of claims 10 or 17 wherein said communications capability comprises a connection to a network.

32. The apparatus of either of claims 10 or 17 wherein said communications capability comprises facsimile transmission.

33. The apparatus of either of claims 10 or 17 wherein said fit information further includes order processing and shipping information.

34. The apparatus of either of claims 10 or 17 wherein each of said plurality of try-on apparel includes a measuring device attached to an edge of it having an adjustable hem length, whereby said edge can be turned up and measured by said measuring device for capturing a desired hem length as part of said fit information.

35. An apparatus for custom tailoring and manufacturing apparel of selected design and configuration, comprising:

a plurality of try-on apparels, each try-on apparel having pre-determined dimensions differing from the dimensions of each other try-on apparel and each try-on apparel bearing a code indicating its pre-determined dimensions;

a plurality of patterns for manufacturing the apparel of selected design and configuration, each of said plurality of patterns having a code and pre-determined dimensions corresponding to one of said plurality of try-on apparel;

a system for storing and accessing information about said codes and pre-determined dimensions of said try-on apparels and said patterns, said system associated with a device for collecting final approved fit dimensions;

a manufacturing system for cutting, tracking, stitching, treating and shipping finished apparel of selected design and configuration constructed from coded patterns and parts according to said approved fit dimensions.

36. The apparatus of claim 35 further comprising a marker imposed upon each of said plurality of try-on apparel.

37. The apparatus of claim 35 wherein said marker comprises a label.

38. The apparatus of claim 35 wherein said marker comprises a washable substance.

39. The apparatus of claim 35 wherein said code further comprises the numeric dimensions of said try-on apparel.

40. The apparatus of claim 35 wherein said code further comprises a bar code image.

41. The apparatus of claim 35 wherein said patterns are laid out to maximize use of materials.

42. The apparatus of claim 35 wherein said manufacturing system is responsive to volume and arrival time of orders in such a way as to optimize inventories.

43. The apparatus of claim 35 wherein said manufacturing system is responsive to volume and arrival time of orders in such a way as to optimize delivery time.

44. An apparatus for custom tailoring and manufacturing apparel of selected design and configuration, comprising:

a plurality of try-on apparels, each try-on apparel having pre-determined dimensions differing from the dimensions of each other try-on apparel and each try-on apparel bearing a code indicating its pre-determined dimensions;

a system for storing and accessing said pre-determined dimensions of said try-on apparels;

a measuring device attached to an edge of each of said try-on apparel having an adjustable hem length, whereby said edge can be turned up and measured by said measuring device for capturing a desired hem length;

a device associated with said system for collecting the relative fit information of each of the predetermined dimensions of those try-on apparels actually tried on by a prospective buyer, together with desired hem length selected by said buyer and reporting said hem length and said fit information for identifying final approved pre-determined dimensions for manufacturing.

45. The apparatus of claim 44 further comprising a plurality of patterns, each of said patterns corresponding to one of said plurality of try-on apparels and hem lengths.

46. The apparatus of claim 44 wherein said measuring device is a tape made of a flexible material having increment markings on it.

47. The apparatus of claim 44 wherein said markings include all permissible dimensions of hem length for said part in said try-on apparel.

48. A method for custom tailoring and manufacturing apparel of selected design and configuration, comprising the steps of:

making a plurality of try-on apparels, each try-on apparel having pre-determined dimensions differing from the dimensions of each other try-on apparel and each try-on apparel bearing a code indicating its pre-determined dimensions;

storing and accessing said pre-determined dimensions of each of said try-on apparels in a system capable of receiving fit information from a prospective buyer regarding those try-on apparels actually tried on by such buyer;

associating a device with said system for collecting the relative fit information of each of the predetermined dimensions of said try-on apparels actually tried on by a prospective buyer and reporting said fit information for identifying final approved pre-determined dimensions for manufacturing.

49. The method of claim 48 further comprising the step of making a plurality of patterns, each of said patterns corresponding to one of said plurality of try-on apparels and bearing its code.

50. The method of claim 48 wherein the step of accessing and storing includes incorporating rules for suggesting try-on apparels to use to determine acceptable fit.

51. The method of claim 48 wherein the step of making a plurality of patterns includes the step of breaking each pattern into parts, each part bearing a code corresponding to said pattern.

52. The method of claim 51 comprising a further step of marking materials cut to correspond to said parts with said pattern's code.

53. The method of claim 48 wherein the step of making said try-on apparels further comprises the step of choosing women's pants as said selected design and configuration.

54. The method of claim 48 wherein the step of making said try-on apparels further comprises the step of choosing footwear as said selected design and configuration.

55. The method of claim 48 wherein the step of making a plurality of try-on apparels includes the step of attaching a measuring device to an edge of each of said plurality of try-on apparel having an adjustable hem length,whereby said edge can be turned up and measured by said measuring device for capturing a desired hem length.

56. A method for custom tailoring and manufacturing apparel of selected design and configuration, comprising the steps of:

storing and accessing dimension and code information in an electronic device, said electronic device having a communications capability, and a capability for receiving fit information from a prospective buyer regarding those try-on apparels actually tried on by such buyer;

making a plurality of try-on apparels, each try-on apparel having pre-determined dimensions differing from the dimensions of each other try-on apparel and each try-on apparel bearing a code indicating its pre-determined dimensions, said code and said pre-determined dimensions being stored in said electronic device for each of said try-on apparels;

associating an indicator device with said electronic device for collecting the relative fit information of each of the predetermined dimensions of those try-on apparels actually tried on by a prospective buyer and reporting said fit information for identifying final approved predetermined dimensions for manufacturing.

57. The method of claim 56 further comprising the step of making a plurality of patterns, each of said patterns corresponding to one of said plurality of try-on apparels.

58. The method of claim 57 wherein the step of making a plurality of said patterns further includes the step of making parts, each part bearing a code corresponding to said pattern.

59. The method of claim 58 comprising the step of cutting materials to correspond to said parts includes the step of marking such materials with said pattern's code.

60. The method of claim 56 wherein the step of making a plurality of try-on apparels includes the step of attaching a measuring device to an edge of each of said plurality of try-on apparel having an adjustable hem length,whereby said edge can be turned up and measured by said measuring device for capturing a desired hem length.

61. A method for custom tailoring and manufacturing apparel of selected design and configuration, comprising:

deriving expert system rules for storing and accessing dimension information in a computer system, said computer system having a communications capability;

making a plurality of try-on apparels, each try-on apparel having pre-determined dimensions differing from the dimensions of each other try-on apparel and each try-on apparel bearing a code indicating its pre-determined dimensions, said code and said pre-determined dimensions being stored in said computer system for each of said try-on apparels;

associating an indicator device with said computer system for collecting the relative fit information of each of the predetermined dimensions of those try-on apparels actually tried on by a prospective buyer and reporting said fit information for identifying final approved predetermined dimensions for manufacturing.

62. The method of claim 61 further comprising the step of making a plurality of patterns, each of said patterns corresponding to one of said plurality of try-on apparels.

63. The method of claim 62 wherein the step of making a plurality of said patterns further includes the step of making parts, each part bearing a code corresponding to said pattern.

64. The method of claim 63 wherein the step of cutting materials to correspond to said parts includes the step of marking such materials with said pattern's code.

65. The method of claim 61 wherein the step deriving expert system rules further comprises deriving said expert system rules by empirically analyzing actual use of prototypes of said plurality of try-on apparel, and analyzing measurements made, to determine the number of try-on apparels to make and their dimensions.

66. The method of claim 61 wherein the step of deriving expert system rules further comprises including rules limiting incremental changes in dimensions of said try-on apparels to those detectable by target consumers.

67. The method of claim 61 wherein the step of deriving expert system rules further comprises including rules limiting the number of try-on apparels to recommend to a prospective buyer according to pre-determined constraints.

68. The method of claim 61 the step of deriving expert system rules further comprising including rules disabling dimensional choice options during processing as those dimensional choice options no longer apply to the try-on apparels likely to fit.

69. The method of claim 61 further comprising the step of associating an interactive indicator device with said computer system.

70. The method of either claim 56 or 61 wherein the step of associating said indicator device includes the step of making it interactive.

71. The method of either claim 56 or 61 wherein the step of associating said indicator device further includes coupling a display screen to a keyboard.

72. The method of either claim 56 or 61 wherein the step of associating said indicator device further coupling a touch-screen display with said system.

73. The method of either claim 56 or 61 wherein the step of associating said indicator device further includes coupling a voice activated system to said system.

74. The method of either claim 56 or 61 wherein the step of associating said indicator device further includes the step of controlling it by an easy to use interface.

75. The method of either claim 56 or 61 wherein communications capability further comprises the step of connecting it to a network.

76. The method of either claim 56 or 61 wherein communications capability further comprises the step of including capabilities for facsimile transmission.

77. The method of either claim 56 or 61 wherein the step of identifying said fit information further includes the step of including order processing and shipping information.

78. The method of either claim 56 or 61 wherein the step of making a plurality of said try-on apparels includes the step of attaching a measuring device to an edge of each of said plurality of try-on apparel having an adjustable hem length, whereby said edge can be turned up and measured by said measuring device for capturing a desired hem length as part of said fit information.

79. A method for custom tailoring and manufacturing apparel of selected design and configuration, comprising the steps of:

making a plurality of try-on apparels, each try-on apparel having pre-determined dimensions differing from the dimensions of each other try-on apparel and each try-on apparel bearing a code indicating its pre-determined dimensions;

making a plurality of patterns, each pattern having a code and pre-determined dimensions corresponding to one of said try-on apparels;

marking each part of materials cut from each pattern with the code corresponding to said pattern using a marker;

storing and accessing information about said codes and pre-determined dimensions of said try-on apparels and said patterns in a system, said system associated with a device for collecting final approved fit dimensions;

manufacturing finished apparel of selected design and configuration by cutting, tracking, stitching, treating and shipping apparels constructed from coded patterns and parts according to said approved fit dimensions.

80. The method of claim 79 wherein the step of marking includes using labels as said markers.

81. The method of claim 79 the step of marking includes using a washable substance as said marker.

82. The method of claim 79 wherein the step of marking includes a step for marking each of said plurality of try-on apparel.

83. The method of claim 79 wherein the step of marking includes the step of using as said code the numeric dimensions of said try-on apparel.

84. The method of claim 79 wherein the step of marking includes the step of using as said code a bar code image.

85. The method of claim 79 wherein the step of making a plurality of patterns further includes the step of laying them out optimizing use of materials.

86. The method of claim 79 wherein the step of manufacturing finished apparel further includes the step of responding to volume and arrival time of orders in such a way as to optimize inventories.

87. The method of claim 79 wherein the step of manufacturing finished apparel further includes the step of responding to volume and arrival time of orders in such a way as to optimize delivery time.

88. A method for custom tailoring and manufacturing apparel of selected design and configuration, comprising:

making a plurality of try-on apparels, each try-on apparel having pre-determined dimensions differing from the dimensions of each other try-on apparel and each try-on apparel bearing a code indicating its pre-determined dimensions;

storing and accessing said pre-determined dimensions of said try-on apparels in a system;

attaching a measuring device to an edge of each of said plurality of try-on apparel having an adjustable hem length,whereby said edge can be turned up and measured by said measuring device for capturing a desired hem length;

associating a device with said system for collecting the relative fit information of each of the predetermined dimensions of those try-on apparels actually tried on by a prospective buyer, together with desired hem length selected by said buyer and reporting said hem length and said fit information for identifying final approved pre-determined dimensions for manufacturing.

89. The method of claim 88 further comprising the step of making a plurality of patterns, each of said patterns corresponding to one of said plurality of try-on apparels and hem lengths.

90. The method of 88 wherein the step of attaching a measuring device further includes the step of fashioning it as a tape made of a flexible material having increment markings on it.

91. The method of claim 90 wherein the step of marking said tape includes the step of indicating all permissible dimensions of hem length for said part in said try-on apparel.

92. A method of collecting dimension information for custom tailoring and manufacturing apparel of selected design and configuration, comprising the steps of:

determining population sample size and dimensions to measure;

gathering measurements of individuals in population sample size in said dimensions;

observing objective differences of said dimensions detectable by individuals;

generating rule sets based on said measurements.

93. The method of claim 92 further comprising the steps of:

making a plurality of try-on apparels, each try-on apparel having pre-determined dimensions based on said measurements and differing from the dimensions of each other try-on apparel and each try-on apparel bearing a code indicating its pre-determined dimensions.

94. The method of claim 93 further comprising the step of forming a plurality of patterns, each pattern having a code and pre-determined dimensions corresponding to one of said plurality of try on apparel.

* * * * *

UNITED STATES PATENT AND TRADEMARK OFFICE

CERTIFICATE OF CORRECTION

PATENT NO. : 5,548,519
DATED : 08/20/96
INVENTOR(S) : Sung K. Park

It is certified that error appears in the above-indentified patent and that said Letters Patent is hereby corrected as shown below:

Column 6, line 28
"AS" should be --A5--.

Signed and Sealed this

Eighteenth Day of February, 1997

Bruce Lehman

*Attest:*

BRUCE LEHMAN

*Attesting Officer*

*Commissioner of Patents and Trademarks*